US009362612B2

(12) United States Patent
Liu et al.

(10) Patent No.: US 9,362,612 B2
(45) Date of Patent: Jun. 7, 2016

(54) WIRELESS COMMUNICATION DEVICE

(71) Applicant: FIH (Hong Kong) Limited, Kowloon (HK)

(72) Inventors: Chi-Sheng Liu, New Taipei (TW); Chuan-Chou Chi, New Taipei (TW); Chih-Yang Tsai, New Taipei (TW); Pai-Cheng Huang, New Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 128 days.

(21) Appl. No.: 14/084,725

(22) Filed: Nov. 20, 2013

(65) Prior Publication Data

US 2014/0340270 A1 Nov. 20, 2014

(30) Foreign Application Priority Data

May 17, 2013 (TW) ..... 102117672 A

(51) Int. Cl.

| | |
|---|---|
| ***H01Q 11/12*** | (2006.01) |
| ***H01Q 1/24*** | (2006.01) |
| ***H01Q 9/14*** | (2006.01) |
| ***H01Q 9/42*** | (2006.01) |

(52) U.S. Cl.
CPC ..... *H01Q 1/243* (2013.01); *H01Q 9/14* (2013.01); *H01Q 9/42* (2013.01)

(58) Field of Classification Search
CPC ..... H01Q 9/14
USPC ..... 343/723
See application file for complete search history.

(56) References Cited

U.S. PATENT DOCUMENTS

2007/0085745 A1* 4/2007 Su et al. ..... 343/700 MS

* cited by examiner

*Primary Examiner* — Graham Smith
(74) *Attorney, Agent, or Firm* — Novak Druce Connolly Bove + Quigg LLP

(57) ABSTRACT

A wireless communication device includes a cover, an antenna, and an adjusting member. The adjusting member is slidably mounted to the cover and is made of non-conductive materials. The antenna includes a extending portion, the extending portion is sandwiched between the cover and the adjusting member. The adjusting member contacts and partially overlaps with the extending portion, the adjusting member slides relative to the cover to change contact positions of the extending portion and the adjusting member.

2 Claims, 4 Drawing Sheets

WIRELESS COMMUNICATION DEVICE

CROSS-REFERENCE TO RELATED APPLICATIONS

This application is one of the three related co-pending U.S. patent applications listed below. All listed applications have the same assignee. The disclosure of each of the listed applications is incorporated by reference into each of the other listed applications.

| U.S. application Ser. No. | Title | Inventors |
|---|---|---|
| 13/956602 | WIRELESS COMMUNICATION DEVICE | CHI-SHENG LIU |
| 13/956614 | WIRELESS COMMUNICATION DEVICE | CHI-SHENG LIU |
| 14/084725 | WIRELESS COMMUNICATION DEVICE | CHI-SHENG LIU |

BACKGROUND

1. Technical Field

The present disclosure relates to wireless communication devices, and particularly to a wireless communication device having the ability to fine-tune the operating frequencies of the wireless signals operated on by an antenna.

2. Description of Related Art

Antennas are important elements of wireless communication devices (such as mobile phones). When working conditions of the wireless communication devices change (e.g., ambient temperatures, humidity, and photographic methods), working characteristics of the antennas are easily influenced. Thus, frequency offset of the antennas may occur, i.e., the central frequencies of wireless signals sent/received by the antennas may change. As a result, communication quality of the wireless communication devices may be adversely affected.

Therefore, there is room for improvement within the art.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the disclosure. Moreover, in the drawings, like reference numerals designate corresponding parts throughout the views.

DETAILED DESCRIPTION

Figure 1:
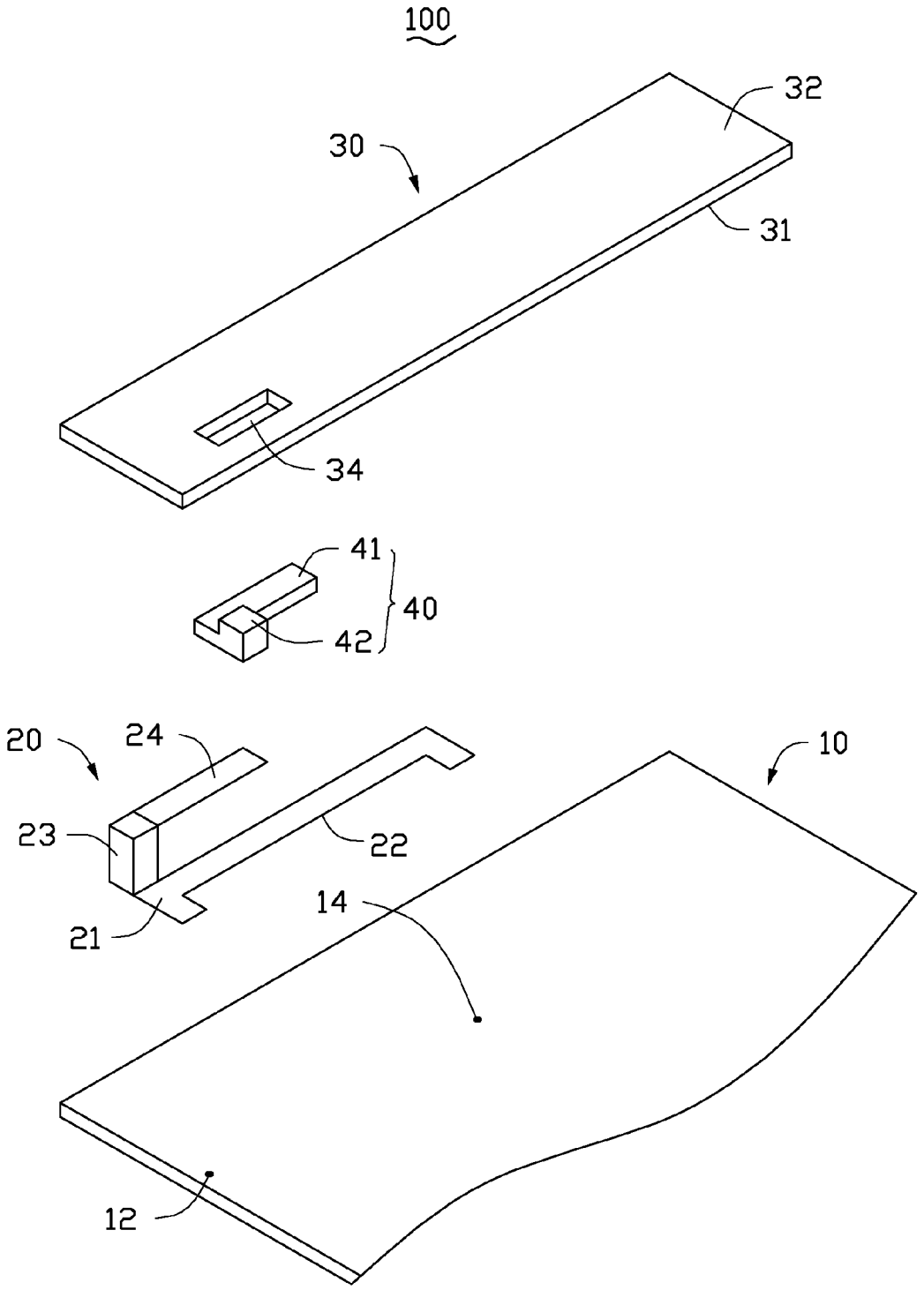
FIG. 1 is an exploded view of a wireless communication device, according to an exemplary embodiment.

FIG. 1 shows a wireless communication device 100, according to an exemplary embodiment. The wireless communication device 100 can be a mobile phone or a personal digital assistant (PDA).

In one exemplary embodiment, the wireless communication device 100 includes a base 10, an antenna 20, a cover 30, and an adjusting member 40.

The base 10 can be a printed circuit board (PCB) of the wireless communication device 100. A feed connector 12 and a grounding connector 14 are flush with the base 10. The feed connector 12 provides current to the antenna 20, and the antenna 20 is grounded by the grounding connector 14.

The antenna 20 is made of conductive materials, such as metal and is used to receive/send wireless signals, such as wireless fidelity (WIFI) signals or BLUETOOTH (BT) signals. In the exemplary embodiment, the antenna 20 includes a feed end 21, a grounding end 22, a connecting portion 23, and an extending portion 24. The feed end 21 is a planar sheet, and is horizontally flush with the base 10 and electrically connected to the feed connector 12. The grounding end 22 is an L-shaped sheet, a first end of the grounding end 22 is electrically connected to the grounding connector 14, and a second end of the grounding end 22 is connected to the feed end 21.

In one exemplary embodiment, the connecting portion 23 is a rectangle post. The connecting portion 23 is perpendicularly connected to a junction of the feed end 21 and the grounding end 22, and supports the extending portion 24 above the base 10.

The extending portion 24 is a planar sheet, a first end of the extending portion 24 is connected to an end opposite to the feed end 21 of the connecting portion 23, a second end of the extending portion 24 extends away from the connecting portion 23, and is parallel to the grounding end 22.

The cover 30 covers the base 10 and the antenna 20, and includes an inner surface 31 and an outer surface 32 opposite to the inner surface 31. The cover 30 further defines a mounting hole 34 communicating with the inner surface 31 and the outer surface 32. When the antenna 20 is covered by the cover 30, the extending portion 24 is substantially flush with the inner surface 31.

The adjusting member 40 is made of metal or some other conductive material. The adjusting member 40 includes a sliding board 41 and an operating portion 42. The sliding board 41 is adjacent to the inner surface 31 of the cover 30, and thus a gap (not labeled) is defined between the sliding board 41 and the inner surface 31 to receive at least a part of the extending portion 24. The operating portion 42 is formed on a side of the extending portion 41, and passes through the mounting hole 34.

In assembly, the extending portion 24 is received in the gap, and is sandwiched between the sliding board 41 and the cover 30. Thus, the sliding board 41 contacts and partially overlaps with the extending portion 24, thereby jointly forming a radiator 29 (see FIG. 3) of the antenna 20. Manually pushing the operating portion 42 causes the sliding board 41 to slide relative to the cover 30 to change contact positions between the sliding board 41 and the extending portion 24. In one exemplary embodiment, an original contact position between the sliding board 41 and the extending portion 24 allows the antenna 20 to receive/send wireless signals at a central frequency of about 2400 MHz, such as BLUETOOTH signals.

Figure 2:
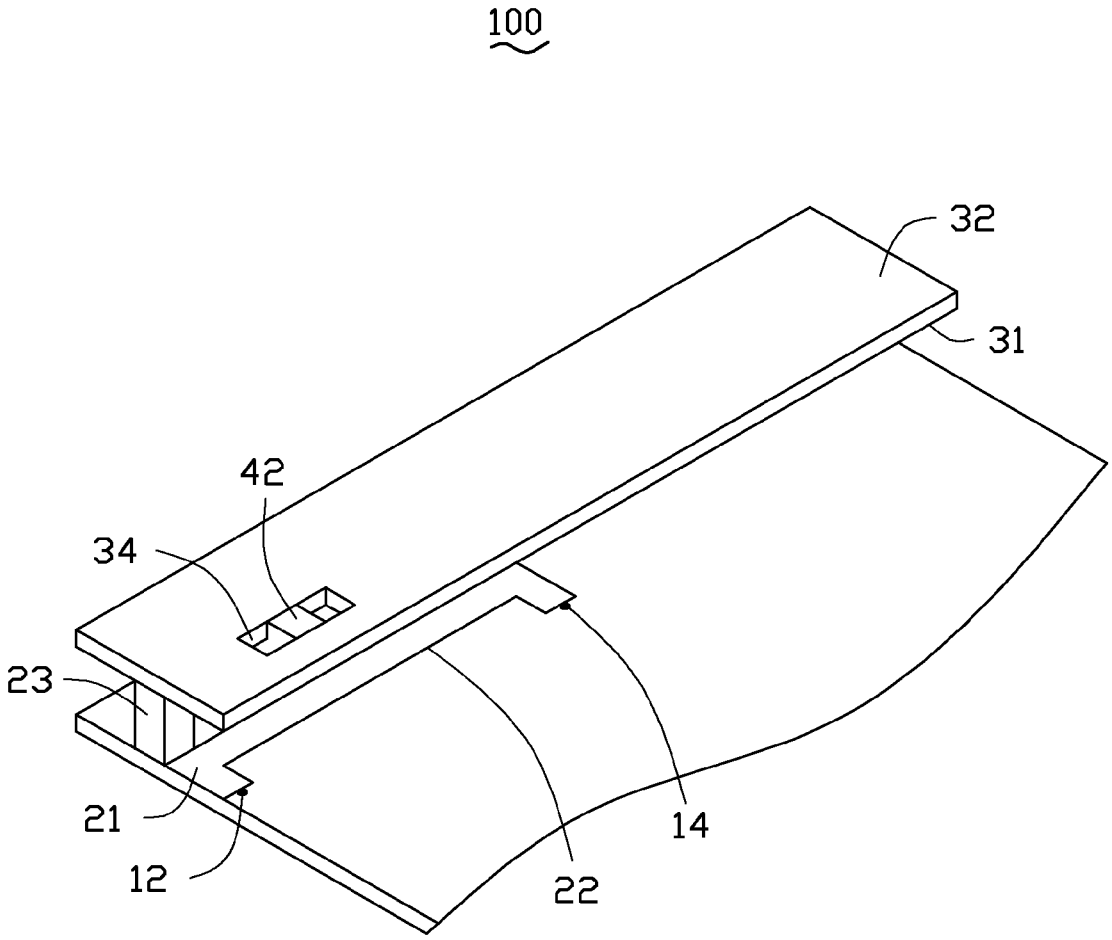
FIG. 2 is an assembled, isometric view of the wireless communication device of FIG. 1 in a first state.
Figure 3:
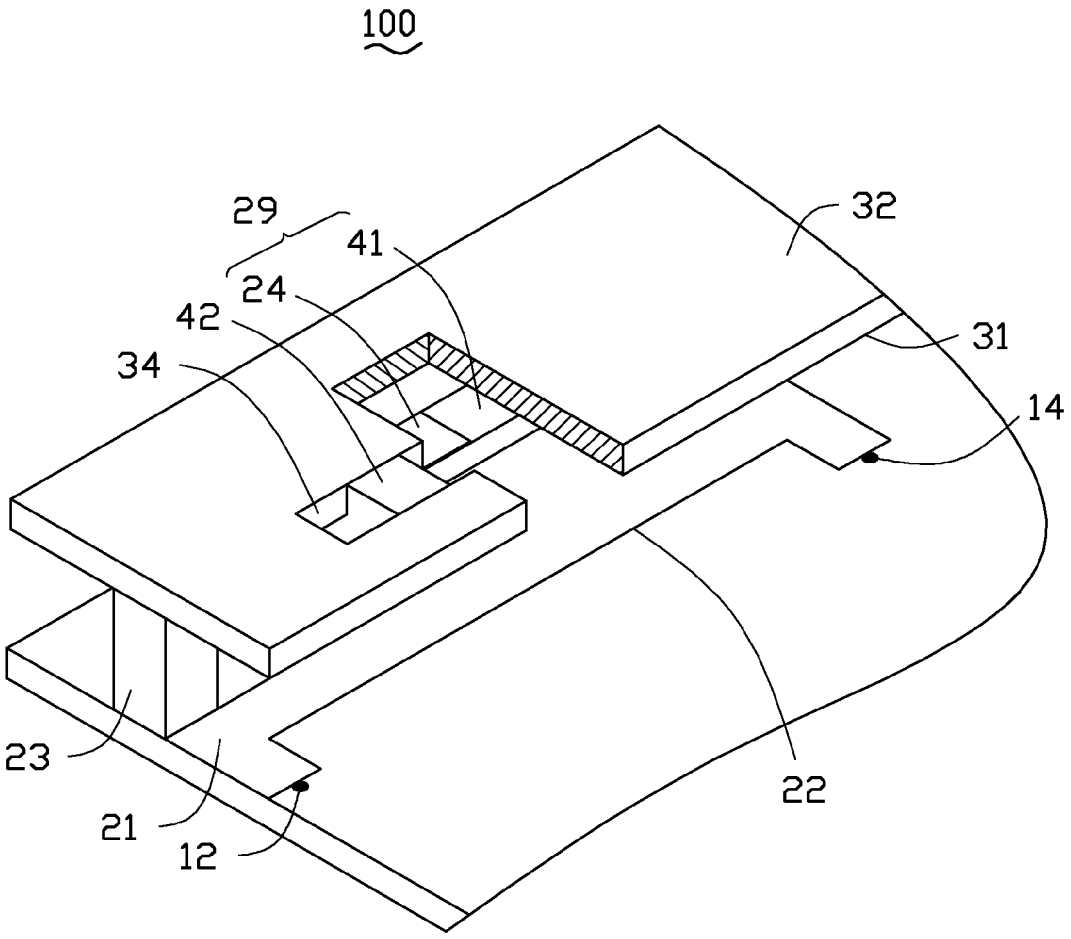
FIG. 3 is a partially cross-sectional view of the wireless communication device of FIG. 2.

FIGS. 2-3 show that when the wireless communication device 100 is in use in a first state, if working conditions of the wireless communication devices change (e.g., ambient temperatures, humidity, and photographic methods), frequency offset of the antenna 20 may occur. For example, if the central frequencies of the wireless signals are increased, the operating portion 42 is pushed to allow the sliding board 41 to slide away from the connecting portion 23. Thus, a total current length of the sliding board 41 and the extending portion 24 is increased, and a resonance wavelength required by the antenna 20 is increased. Thus, the central frequencies of the wireless signals are decreased, and the frequency offset of the antenna 20 is eliminated to receive/send desired wireless signals.

Figure 4:
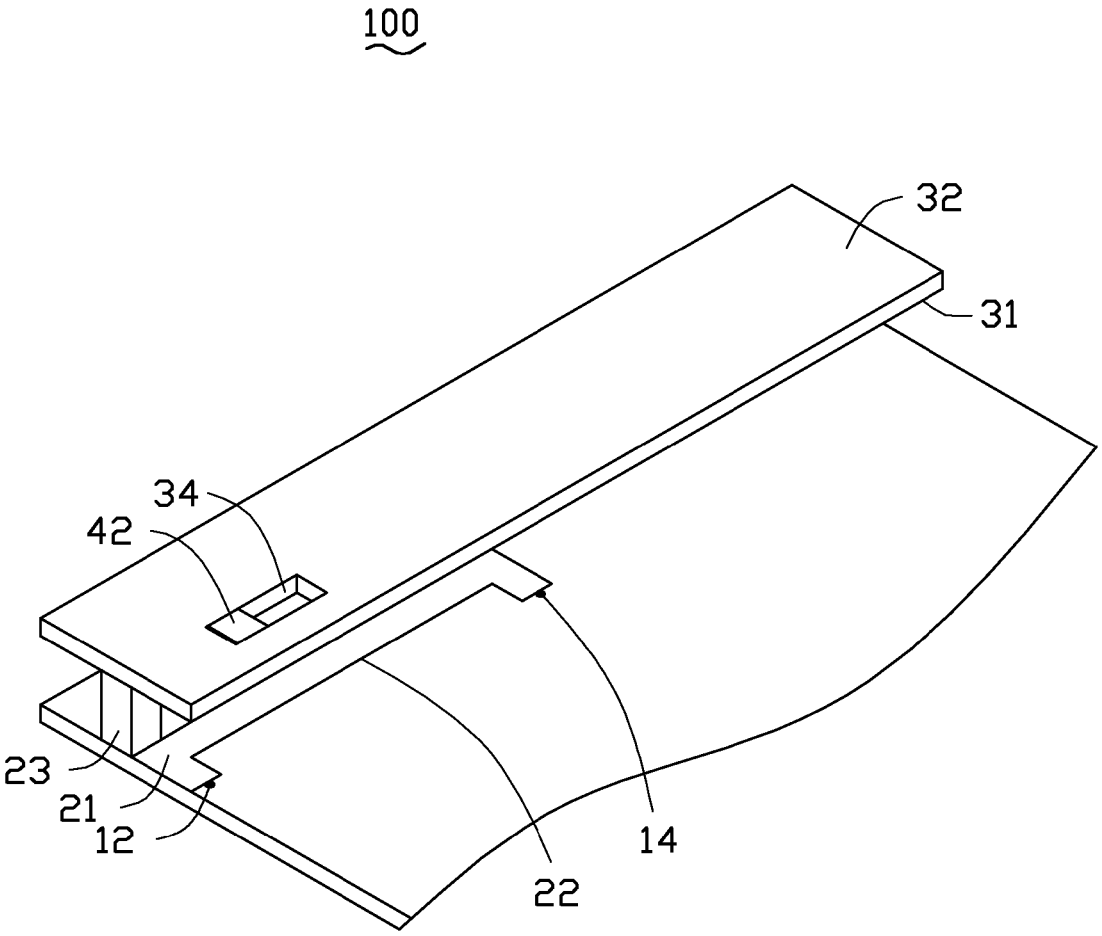
FIG. 4 is an assembled, isometric view of the wireless communication device of FIG. 1 in a second state.

FIG. 4 shows that when the wireless communication device 100 is in use in a second state, if the central frequencies of the wireless signals are decreased, the operating portion 42 is pushed to allow the sliding board 41 to slide towards the connecting portion 23. Thus, a total current length of the sliding board 41 and the extending portion 24 is decreased, and a resonance wavelength required by the antenna 20 is decreased. Thus, the central frequencies of the wireless signals are increased, and the frequency offset of the antenna 20 is eliminated.

The adjusting member 40 slides relative to the cover 30 to change the contact positions between the sliding board 41 and the extending portion 24. Thus, the resonance wavelength required by the antenna 20 can be adjusted to balance the central frequencies of the wireless signal received/sent by the antenna 20. Therefore, communication quality of the wireless communication device 100 can be improved.

It is to be understood, however, that even through numerous characteristics and advantages of the present disclosure have been set forth in the foregoing description, together with details of assembly and function, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A wireless communication device, comprising:

a base;

an antenna disposed on the base, the antenna including an extending portion made of conductive materials, and the extending portion having a lower surface and an upper surface opposite to the lower surface;

a cover covering the base and the extending portion; and an adjusting member slidably mounted to the cover and made of conductive materials, and the extending portion always sandwiched between the cover and the adjusting member, the lower surface of the extending portion resisting the adjusting member, and the upper surface of the extending portion resisting the cover;

wherein the adjusting member contacts and partially overlaps with the extending portion, the adjusting member slides relative to the cover to change contact positions of the extending portion and the adjusting member;

wherein the cover comprises an inner surface and an outer surface opposite to the inner surface, the extending portion is flush with the inner surface;

wherein the adjusting member comprises a sliding board, the sliding board is adjacent to the inner surface, and the extending portion is positioned between the sliding board and the inner surface;

wherein the cover defines a mounting hole communicating with the inner surface and the outer surface, the adjusting member further comprises an operating portion, the operating portion is formed on the sliding board, and passes through the mounting hole;

wherein a feed connector and a grounding connector are positioned on the base, the antenna comprises a feed end and a grounding end, both the feed end and the ground end are made of conductive materials, the feed end is a planar sheet, and is horizontally flush with the base and electrically connected to the feed connector, a first end of the grounding end is electrically connected to the grounding connector, and a second end of the grounding end is connected to the feed end;

wherein the antenna further comprises a connecting portion made of conductive materials, the connecting portion is perpendicularly connected to a junction of the feed end and the grounding end, and supports the extending portion above the base;

wherein the extending portion is a planar sheet, the extending portion is connected to the connecting portion, and is parallel to the grounding end.

2. A wireless communication device, comprising:

a base;

a cover;

an antenna including an extending portion having a lower surface and an upper surface opposite to the lower surface; and an adjusting member slidably mounted to the cover, and the extending portion always sandwiched between the cover and the adjusting member, the lower surface of the extending portion resisting the adjusting member, and the upper surface of the extending portion resisting the cover;

wherein the adjusting member contacts and partially overlaps with the extending portion to jointly forming a radiator of the antenna, the adjusting member slides relative to the cover to change a total current length of the radiator;

wherein the adjusting member is made of conductive materials;

wherein the cover comprises an inner surface and an outer surface opposite to the inner surface, the extending portion is flush with the inner surface;

wherein the adjusting member comprises a sliding board, the sliding board is adjacent to the inner surface, and the extending portion is positioned between the sliding board and the inner surface;

wherein the cover defines a mounting hole communicating with the inner surface and the outer surface, the adjusting member further comprises an operating portion, the operating portion is formed on the sliding board, and passes through the mounting hole;

wherein a feed connector and a grounding connector are positioned on the base, the antenna comprises a feed end and a grounding end, both the feed end and the ground end are made of conductive materials, the feed end is a planar sheet, and is horizontally flush with the base and electrically connected to the feed connector, a first end of the grounding end is electrically connected to the grounding connector, and a second end of the grounding end is connected to the feed end;

wherein the antenna further comprises a connecting portion made of conductive materials, the connecting portion is perpendicularly connected to a junction of the feed end and the grounding end, and supports the extending portion above the base;

wherein the extending portion is a planar sheet, the extending portion is connected to the connecting portion, and is parallel to the grounding end.

* * * * *